US007034224B2

(12) United States Patent
Kim et al.

(10) Patent No.: US 7,034,224 B2
(45) Date of Patent: Apr. 25, 2006

(54) RECEPTACLE

(75) Inventors: Cheon-Youn Kim, Incheon (KR); Dong seb Kim, Kyeongsan-Si (KR); Sul-Kil Lee, Kwangju (KR); Ki-Young Lim, Anyang-Si (KR); Seok-Won Song, Kyeongsan-Si (KR); Dae-Gun Kim, Kyeongsan-Si (KR)

(73) Assignee: Seochang Electric Communication Co., Ltd., Daegu (KR)

( * ) Notice: Subject to any disclaimer, the term of this patent is extended or adjusted under 35 U.S.C. 154(b) by 141 days.

(21) Appl. No.: 10/752,578

(22) Filed: Jan. 8, 2004

(65) Prior Publication Data

US 2004/0140117 A1 Jul. 22, 2004

(30) Foreign Application Priority Data

Jan. 8, 2003 (KR) ..... 10-2003-0001099
Nov. 18, 2003 (KR) ..... 10-2003-0081696

(51) Int. Cl.
*H01H 9/02* (2006.01)

(52) U.S. Cl. ..... 174/53; 174/58; 174/50; 361/42; 335/202; 335/18

(58) Field of Classification Search ..... 174/50, 174/53, 58, 57, 48; 439/181, 88, 183, 536, 439/650, 949; 200/5 R, 5 E, 52 R; 335/18, 335/202, 6, 21, 25, 35, 157, 172, 173; 361/42, 361/43, 44, 45, 46, 47, 48, 49, 50
See application file for complete search history.

(56) References Cited

U.S. PATENT DOCUMENTS

| | | | | |
|---|---|---|---|---|
| 4,010,431 | A | 3/1977 | Virani et al. | |
| 4,595,894 | A * | 6/1986 | Doyle et al. | 335/18 |
| 4,802,052 | A | 1/1989 | Brant et al. | |
| 5,594,398 | A * | 1/1997 | Marcou et al. | 335/18 |
| 5,933,063 | A * | 8/1999 | Keung et al. | 335/18 |
| 6,788,173 | B1 * | 9/2004 | Germain et al. | 335/18 |
| 6,828,886 | B1 * | 12/2004 | Germain et al. | 335/18 |
| 6,864,766 | B1 * | 3/2005 | DiSalvo et al. | 335/18 |

* cited by examiner

*Primary Examiner*—Angel R. Estrada
(74) *Attorney, Agent, or Firm*—Rabin & Berdo, PC

(57) ABSTRACT

A receptacle includes an insulated outer case, first and second trip switches formed on an inner bottom of the insulated case, a reset switch formed on the inner bottom of the insulated outer case, a cover disposed on a top of the outer case, first and second test buttons disposed in the insulated outer case to be movable in a vertical direction, each of the first and second test buttons having a bottom adjacent to the corresponding trip switch and a top exposed through the cover, a first spring for biasing the first and second test buttons to an initial position, a reset button disposed in the insulated outer case to be movable in a vertical direction, the reset button having a bottom adjacent to the reset switch and a top exposed through the cover, and a locking portion for selectively locking the reset button in response to the vertical motion of the first and second test button.

22 Claims, 12 Drawing Sheets

RECEPTACLE

BACKGROUND OF THE INVENTION

1. Field of the Invention

The present invention relates to a receptacle used in an electric power distribution system and more particularly, to a receptacle that can prevent an accident such as a damage of an electric device and a fire in advance, which may be caused by a wire connection fault or an arc fault, by detecting an error caused by the wire connection fault when a service wire is originally distributed in the receptacle and by detecting an error caused by the arc fault generated in a current during the use of the current.

2. Description of the Related Art

Generally, a low voltage (600 V or less) network is used for a distributing board at a specific area such as a city, an industrial area, and a commercial area.

Particularly, a cable of the network is laid under the ground, being designed to be introduced from at least one location.

The cable may be damaged by a variety of causes such as thermal degradation, deterioration, moisture, and damage by rodents.

To protect the network from the causes, a circuit breaker or a receptacle has been used.

In order to insulate the defective cable and to minimize the network interference, a cut-off device such as a fuse that can cut off the cable is provided on opposite ends of the cable.

The cable cut-off device is designed to stably response to a phase-to-phase defect such as a high voltage and low impedance defect.

Meanwhile, in order to prevent the fire or the electric shock, a circuit breaker for a distributing wire and a circuit breaker for a short circuit have been used at home.

The circuit breaker for the distributing wire is used for the purpose of protecting an electric wire. That is, when a current above a rated current is used during the use of a load, the current flowing along the circuit breaker becomes higher than an allowable level, thereby generating heat by which a bimetal of the circuit breaker is bent to cut off the operation of an electric device.

In addition, when there is a short circuit between phases at a load side by an electromotive tool or other metal member, since a high current is generated in a moment, the bimetal is subject to heat so that an inner magnet is activated before the electric device is operated, to cut off the operation of the electric device.

The high current generates a large amount of magnetic field, thereby activating the magnet in the electric device.

The circuit breaker for the short circuit functions to protect a user from an electric shock by detecting a fact that the user receives the electric shock during the use of the electric device and by cutting off the electric power. The circuit breaker for the short circuit also functions as the circuit breaker for the distributing wire.

As the circuit breaker for the short circuit, aground fault-protecting receptacle having a high-sensitive detecting function is well known. Such a ground fault-protecting receptacle is disclosed in Korean Patent No. 078629, entitled "ground malfunction-protecting receptacle."

FIG. 1 illustrates a plane view of a receptacle for protecting a ground malfunction according to the conventional art.

As shown in the drawing, the receptacle includes an insulated outer case 10 having a front cover 20, a rear cover (not shown), and a base (not shown), all of which are formed of an insulating material.

Coupled between the base and the front cover 20 is a mounting yoke 30 formed of a metal plate.

Ground terminals are formed extending from the mounting yoke 30 toward an inside of the base. A plurality of openings 22 are formed on the front cover 20. Ground terminal screws (not shown) are coupled on extending portions of the mounting yoke 30 to provide a connection of an external ground wire when the ground terminals goes in and out through the are shaped openings among the openings 22.

Provided on a central portion of the front cover 20 are a reset button 40 for resetting the operation of the receptacle 10 and a test button 50 for testing a ground fault.

Although the above-described conventional receptacle is designed to be able to detect and test the ground fault, it still has a problem that it cannot detect and test the arc fault caused by a wire damage, a mechanical and electrical stress by an excessive current and an excessive use, a wire connection defect, a mechanical damage of an insulation and wiring structure, and the like.

In addition, the conventional receptacle has a problem that the reset operation is very complicated after the fault test.

Further more, since the conventional receptacle is designed not to test the wire connection fault when the wire is originally distributed, there may be an accident such as a malfunction and damage of an electric device and a fire due to the wire connection fault.

SUMMARY OF THE INVENTION

Therefore, the present invention has been made in an effort to solve the above-described problem.

It is a first object of the present invention to provide a receptacle that is designed to be able to detect and test an arc fault.

It is a second object of the present invention to provide a receptacle that is designed to be reset by a simple operation after a fault test.

It is a third object of the present invention to provide a receptacle that can detect a wire connection fault when a wire is originally distributed.

To achieve the above objects, the present invention provides a receptacle comprising an insulated outer case; first and second trip switches formed on an inner bottom of the insulated case; a reset switch formed on the inner bottom of the insulated outer case; a cover disposed on a top of the outer case; first and second test buttons disposed in the insulated outer case to be movable in a vertical direction, each of the first and second test buttons having a bottom adjacent to the corresponding trip switch and a top exposed through the cover; a first spring for biasing the first and second test buttons to an initial position; a reset button disposed in the insulated outer case to be movable in a vertical direction, the reset button having a bottom adjacent to the reset switch and a top exposed through the cover; and a locking portion for selectively locking the reset button in response to the vertical motion of the first and second test button.

It is preferable, the insulated outer case is provided with first and second button receiving portions for respectively receiving the first and second test buttons.

Preferably, the cover is provided with first and second button holes through which the first and second test buttons are respectively exposed.

Preferably, the first button functions to test an arc fault while the second button functions to test a ground fault.

It is preferable that each of the first and second buttons comprises a press portion supported on the cover to be movable in the vertical direction; a contacting portion for pressing the corresponding trip switch to operate the corresponding trip switch; and a connecting portion for connecting the press portion to the contacting portion.

Each of the first and second buttons further comprises a tap button attached on the contacting potion to press the corresponding trip switch.

It is preferable that the first and second test buttons are symmetrical to each other.

Preferably, the first spring is formed of a leaf spring.

The first and second test buttons are provided with a spring groove in which the first spring is inserted.

The receptacle may further comprise a reset guide for guiding the vertical motion of the reset button; and a press boss for pressing the reset switch in accordance with a vertical motion of the reset guide cooperating with the reset button.

The receptacle may further comprise a second spring for biasing the reset button toward the cover.

Preferably, the locking portion comprises a solenoid magnetized by an electric signal from one of the trip and reset switches that are operated by the test and reset buttons, respectively; a plunger designed to move forward and rearward according to a magnetizing state of the solenoid; a third spring for biasing the plunger to an initial position; and a latch installed on a front end of the plunger to selectively lock the reset button in accordance with an moving direction of the plunger.

Preferably, the reset button is provided at an outer circumference with a hook groove on which the latch is designed to be hooked.

The receptacle may further comprise a fault display lamp disposed in the insulated outer case and exposed through the cover.

The receptacle may further comprise first and second test Lamps disposed on the inner bottom of the insulated outer case to respectively correspond to the bottoms of the first and second test buttons, wherein the first and second test buttons are formed of a transparent material so that light emitted from the test lamp can transmit through the first and second test buttons.

The receptacle may further comprise a reset lamp disposed on the inner bottom of the insulated outer case to correspond to the bottom of the reset button, wherein the reset button is formed of a transparent material so that light emitted from the reset lamp can transmit through the reset button.

According to another aspect of the present invention, there is provided a receptacle comprising an insulated outer case; trip and reset switches formed on an inner bottom of the insulated outer case; a cover disposed on a top of the outer case; a test button disposed in the insulated outer case to be movable in a vertical direction, the test button having a bottom adjacent to the trip switch and a top exposed through the cover; and a reset button disposed in the insulated outer case to be movable in a vertical direction, the reset button having a press portion exposed through the cover and an extending shaft extending from the press portion, the extending shaft being provided at an outer circumference with a hook groove, wherein the receptacle further comprises a reset guide for guiding the reset button, the reset guide being provided at an end with a press boss for pressing the reset switch while moving in a vertical direction; and a locking portion having a latch for selectively latching the extending shaft of the reset button guided by the reset guide to intermit a reset operation of the reset button.

Preferably, the locking portion comprises a solenoid magnetized by an operation of one of the trip and reset switches; a plunger designed to move in a direction by the magnetization of the solenoid, the plunger being coupled on an end of the latch; and a third spring for biasing the plunger to an initial position.

It is preferable that the extending shaft of the reset button is further provided with an intermitting groove below the hook groove, the intermitting groove being designed to be intermitted by the latch of the locking portion when there is a wire connection fault in the receptacle.

Preferably, the locking portion is formed in a semi-cylindrical shape formed by cutting a portion of the extending shaft.

Preferably, the reset guide is provided with an insertion hole through which the extending shaft of the reset button is inserted, a hook passage formed in a perpendicular direction with respect to the insertion hole, a base on which terminals are seated, and a press boss for pressing the reset switch.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

First Embodiment

Figure 1:
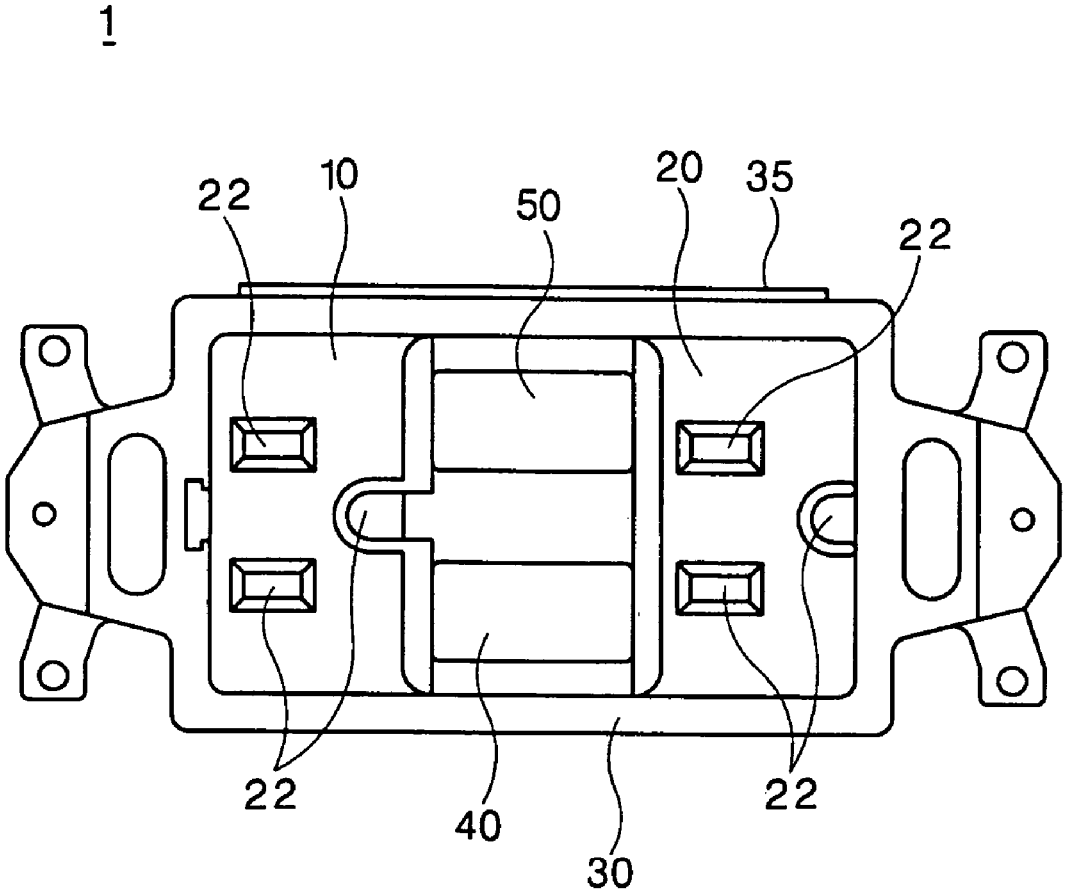
FIG 1 PRIOR ART
FIG. 1 is a plane view of a conventional receptacle.
Figure 2:
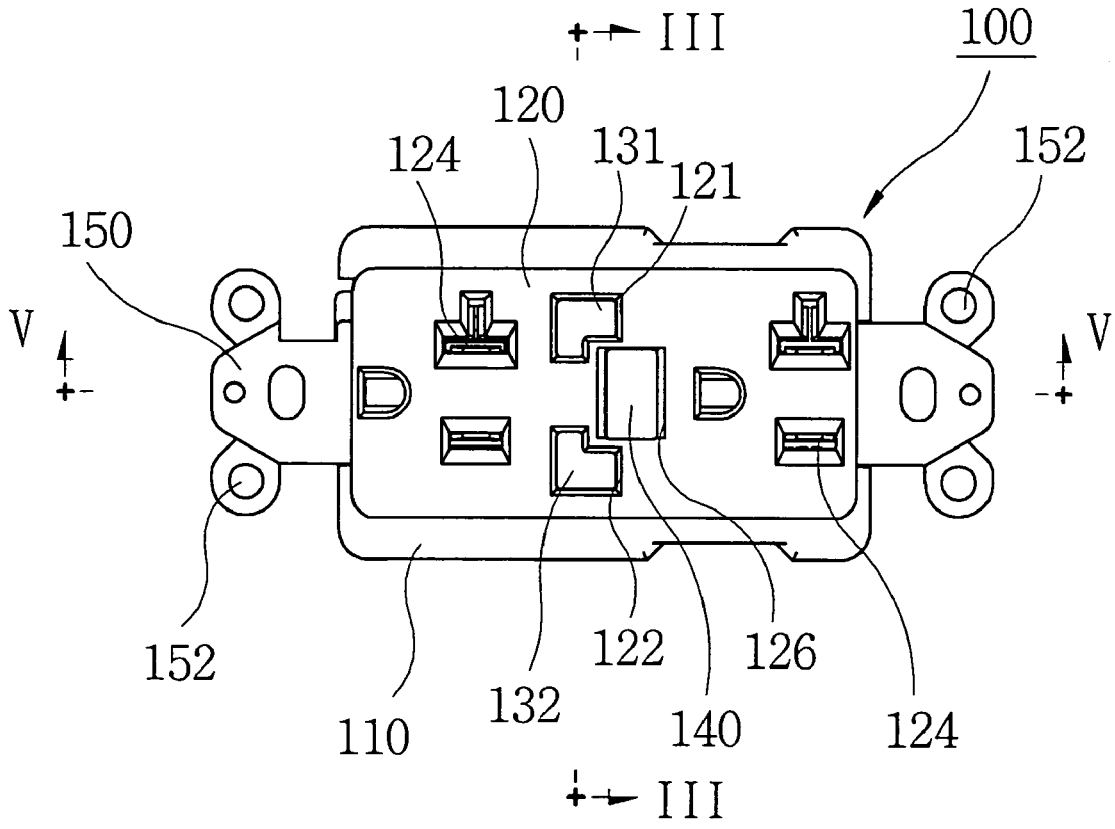
FIG. 2 is a plane view of a receptacle according to a first embodiment of the present invention.

FIG. 2 shows a plane view of a receptacle according to a first embodiment of the present invention.

As shown in the drawing, a receptacle 100 includes an insulated outer case 110, a cover 120 coupled on a top of the insulated outer case 110, first and second buttons 131 and 132 disposed in the outer case 110 and externally exposed through the cover 120, and a reset button 140 disposed in the outer case 110 and externally exposed through the cover 120.

Coupled between the outer case 110 and the cover 120 is a yoke 150 provided at opposite sides with coupling holes 152 to allow the receptacle to be easily fixed on a building wall, on which a service-wire is distributed, by bolts, screws, and the like.

Figure 3:
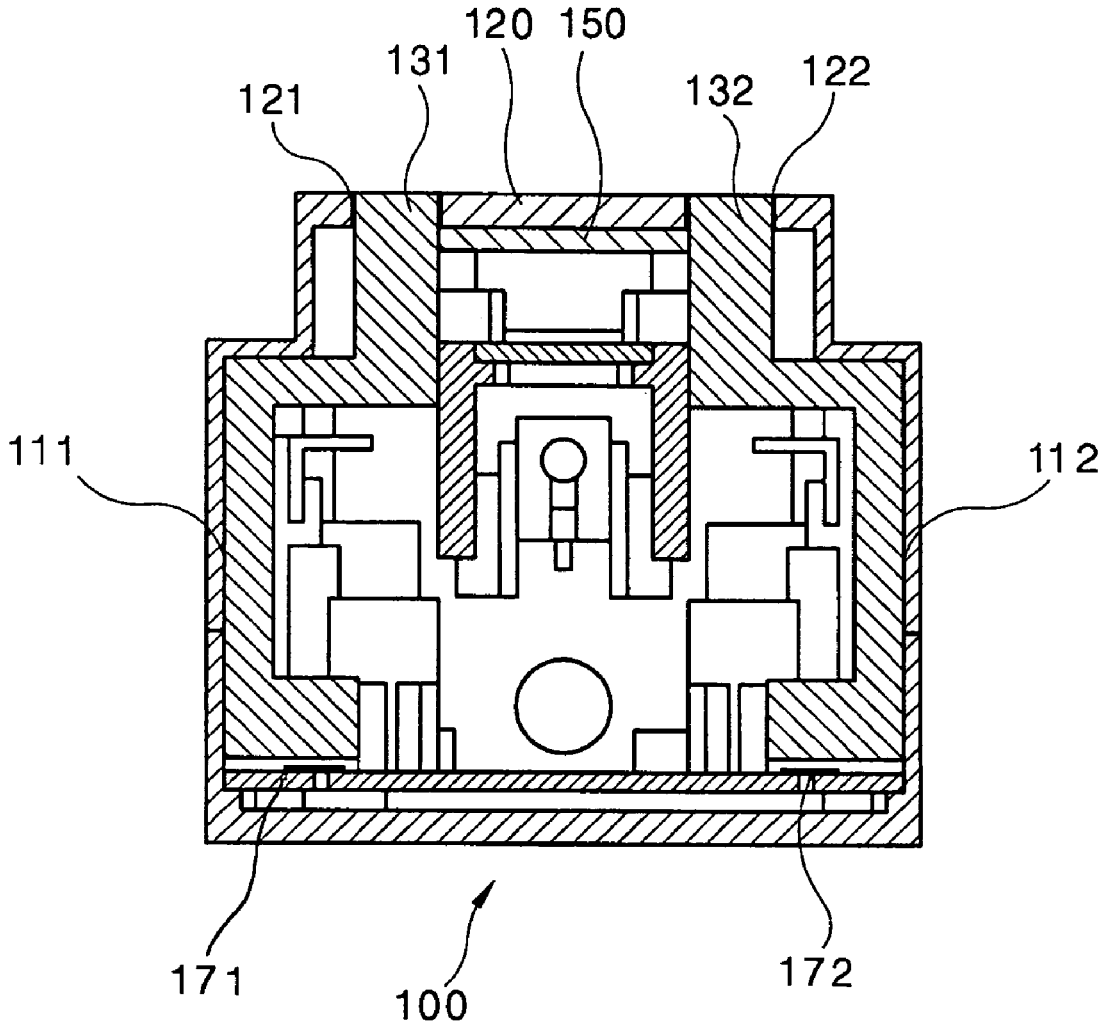
FIG. 3 is a sectional view taken along line III—III of FIG. 2.

FIG. 3 shows a sectional view taken along line III—III of FIG. 2.

Referring to FIGS. 2 and 3, the insulated outer case 110 is provided at inner-opposite sides with first and second receiving portions 111 and 112 for respectively receiving the first and second test buttons 131 and 132.

The cover 120 is provided with first and second button holes 121 and 122 through which tops of the first and second test buttons 131 and 132 are exposed so that a user can selectively operate the first and second test buttons 131 and 132.

That is, the first and second test buttons 131 and 132 are respectively inserted in the first and second button holes 121 and 122 formed on the cover 120, while being installed in the receptacle 100 by the first and second receiving portions 111 and 112.

The first and second test buttons 131 and 132 are designed to respectively press first and second trip switches 171 and 172 disposed on an inner bottom of the outer case 110.

The first and second test buttons 131 and 132 are shaped to correspond to inner walls of the cover 120 and the outer case 110. The first test button 131 functions as an arc test button for detecting and testing an arc fault, while the second test button 132 functions as a ground test button for detecting and testing a ground fault.

Figure 4:
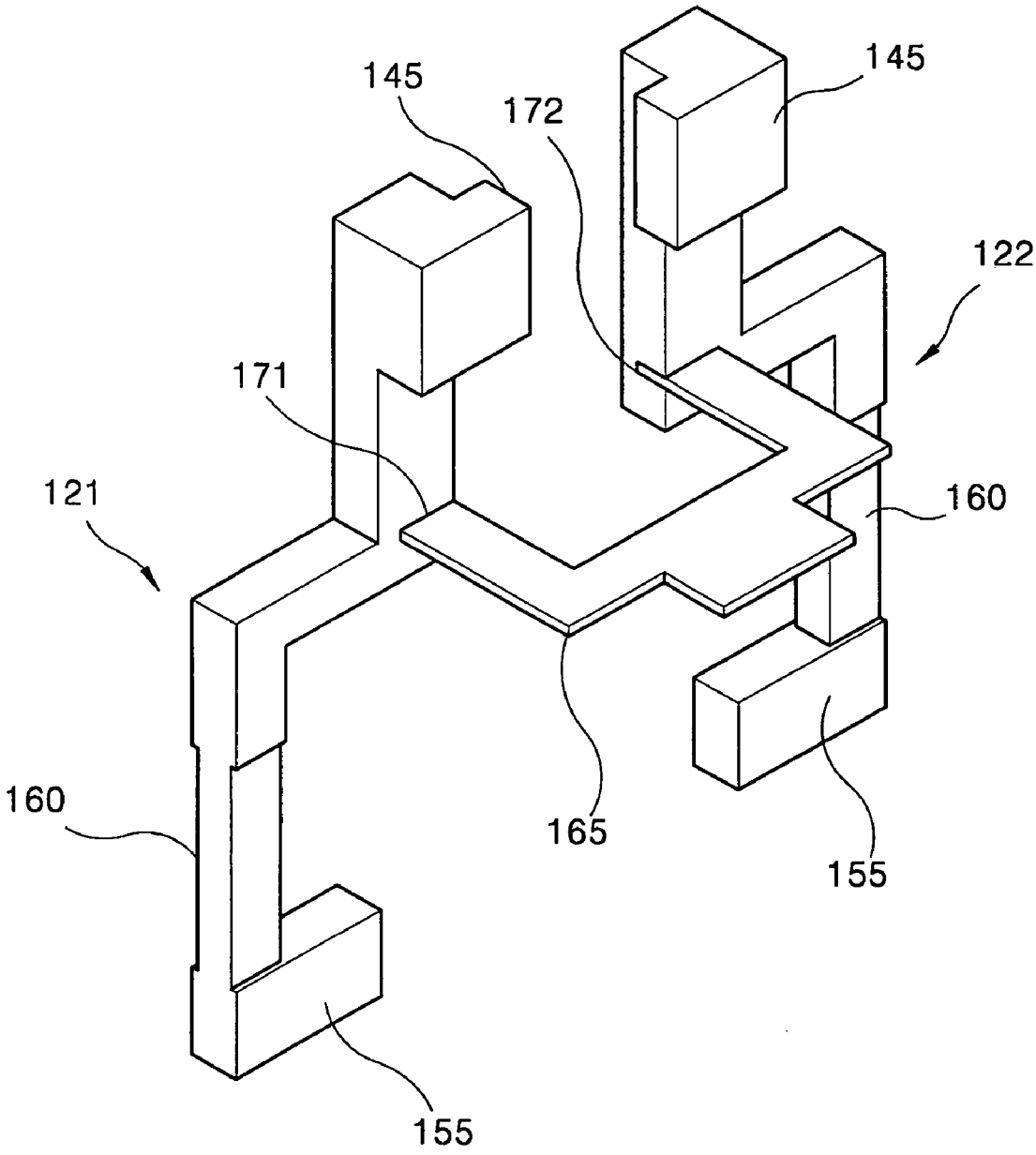
FIG. 4 is an enlarged perspective view illustrating first and second test buttons of a receptacle according to a first embodiment of the present invention.

FIG. 4 shows an enlarged perspective view illustrating the first and second test buttons.

As shown in FIG. 4, the first and second test buttons 131 and 132 are designed to be symmetrical to each other. Each of the first and second test buttons 131 and 132 includes a press portion 1311 (1321) exposed through the button hole 121 (122), a contacting portion 1312 (1322) contacting the trip switch 171 (172) disposed on an inner-lower portion of the outer case 110, and a connecting portion 1313 (1323) for connecting the press portion 1311 (1321) to the contacting portion 1312 (1322).

First and second spring grooves 1314 and 1324 are respectively formed on the connecting portions 1313 and 1323.

Tightly inserted in the first and second spring grooves 1314 and 1324 are opposite sides of a first spring 160 for providing biasing force to the first and second buttons 131 and 132.

The first spring 160 is preferably formed of a leaf spring so that the first spring 160 can be easily mounted in a limited space of the outer case 110.

Although the first and second test buttons 131 and 132 are formed extending toward the lower portion of the outer case 110, corresponding to the inner wall of the outer case, the present invention is not limited to this. That is, the first and second test buttons 131 and 132 can be formed in a variety of designs in accordance with a design condition of a circuit and other parts installed in the receptacle 100.

In addition, the functions of the first and second test buttons 131 and 132 can be varied in accordance with the locations of the first and second trip switches 171 and 172.

There is further provided a reset button 140 installed in the outer case 110 such that a top of the reset button 140 is disposed between the tops of the first and second test buttons 131 and 132. The reset button 140 functions to reset a circuit of the receptacle 100 when the circuit is cut off by a fault such as a short circuit.

Figure 5:
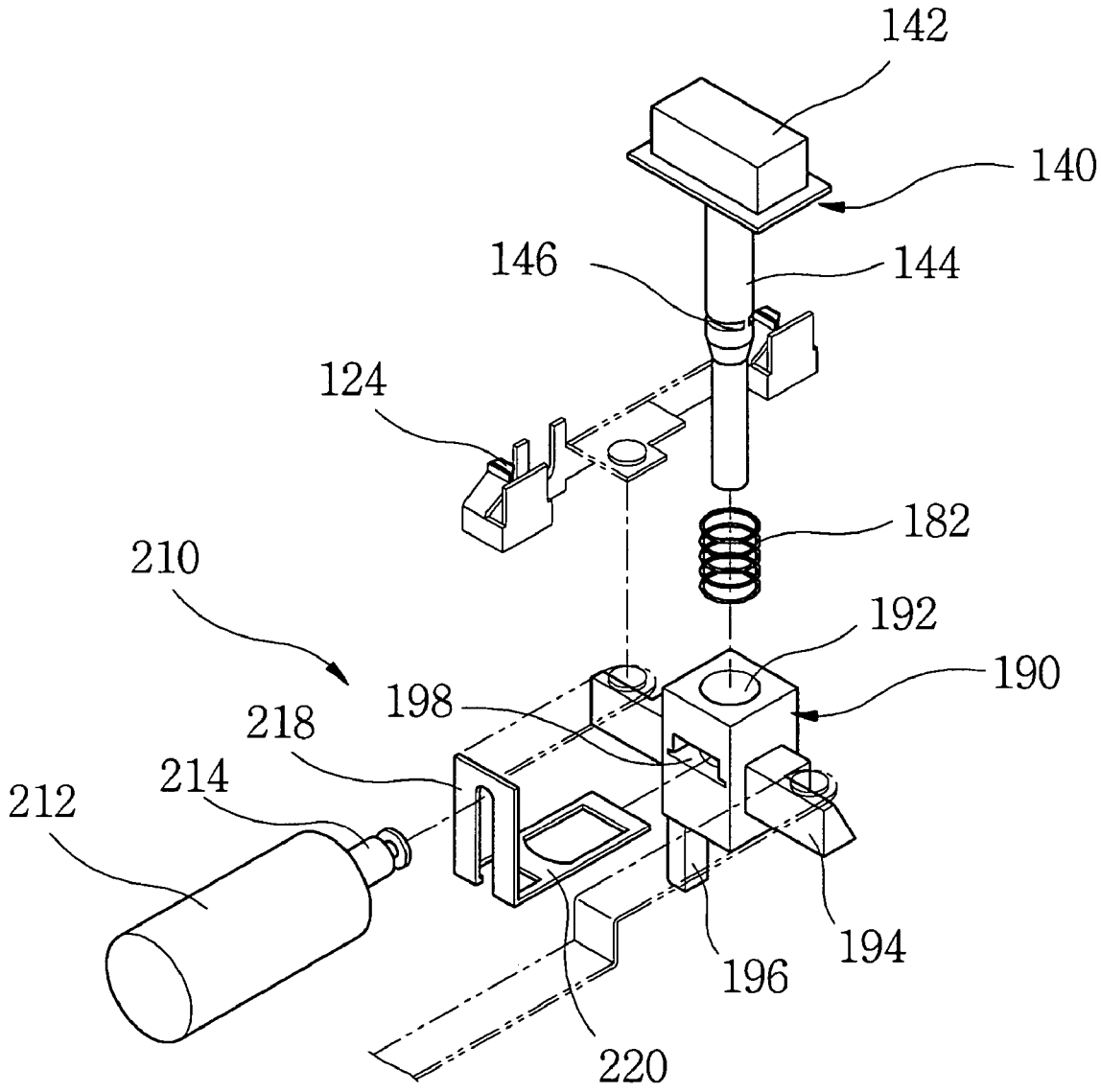
FIG. 5 is a sectional view taken along line V—V of FIG. 2.
Figure 6:
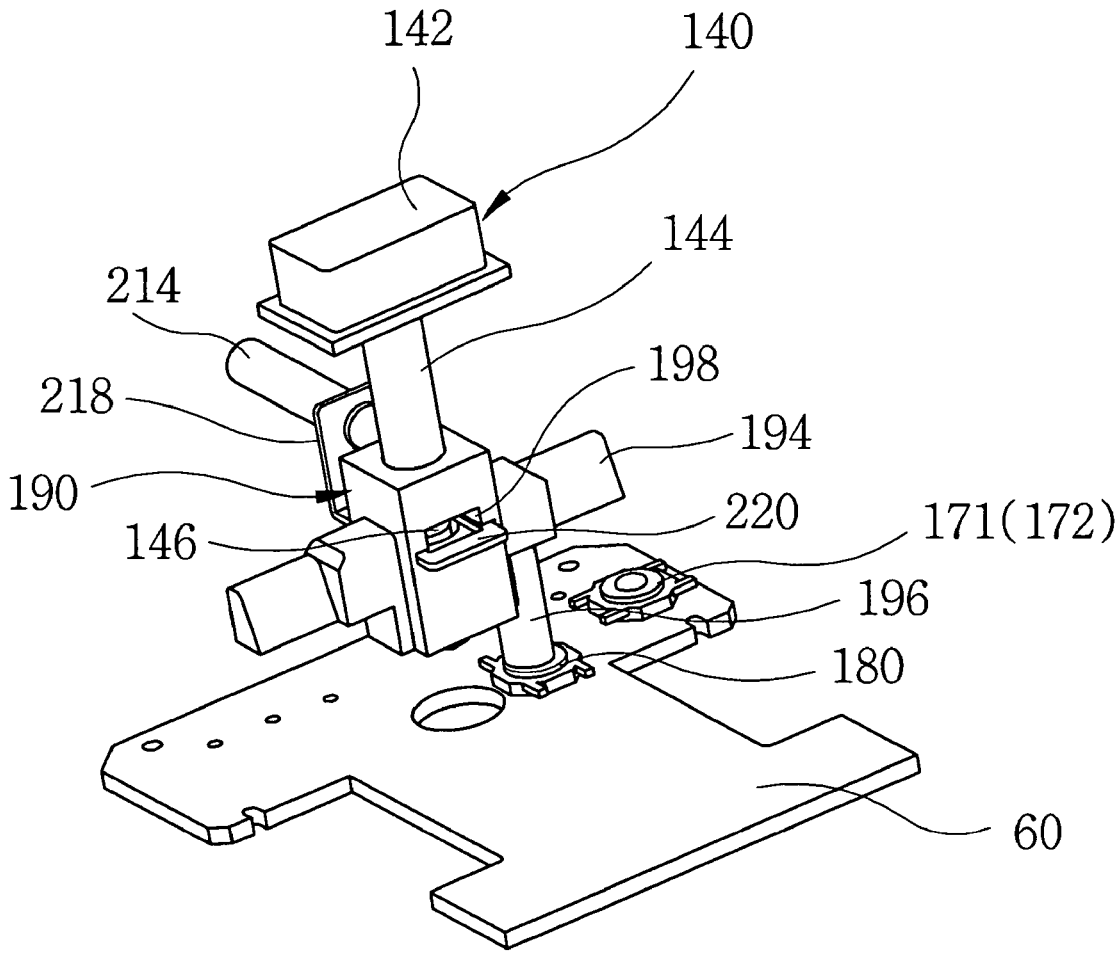
FIG. 6 is an exploded perspective view illustrating a reset button, reset guide, and locking portion of a receptacle according to a first embodiment of the resent invention.
Figure 7:
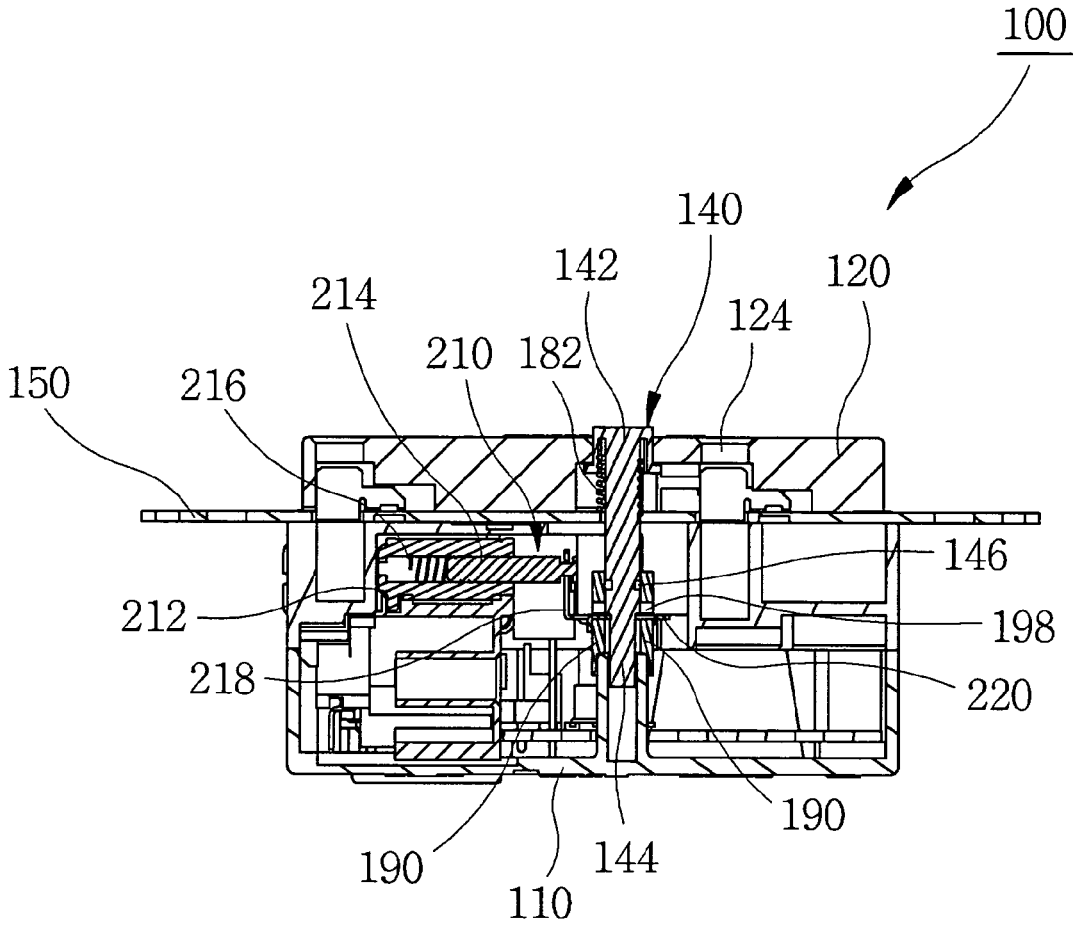
FIG. 7 is an assembled perspective view illustrating a reset button, reset guide, and locking portion of a receptacle according to a first embodiment of the present invention.

FIG. 5 shows a sectional view taken along line V—V of FIG. 2, and FIGS. 6 and 7 respectively show exploded and assembled perspective views illustrating the reset button, a reset guide, and a locking portion.

As shown in the drawings, the reset button 140 includes a press portion 142 externally exposed through the cover 120 and an extending shaft 144 extending downward from the press portion 142.

The extending shaft 144 is provided at an outer circumference with a hook groove 146.

The reset button 140 is disposed to be movable in a vertical direction of the outer case 110 and is biased upward by a second spring 182.

The reset button 140 is inserted in a reset guide 190.

That is, the reset guide 190 is provided with an insertion hole 192 through which the extending shaft 144 of the reset button 140 is inserted, a hook passage 198 formed in a perpendicular direction with respect to the insertion hole 192, a base 194 on which terminals are seated, and a press boss 196 for pressing the reset switch.

There is further provided a locking portion 210 including a solenoid 212 magnetized by an electric signal, a plunger 214 that is designed to be moved in a direction by the magnetization of the solenoid 212, a third spring 216 for returning the plunger 214 to an initial position when the magnetization of the solenoid 212 is released, a bracket 218 coupled on a front end of the plunger 214, and a latch 220 extending from the bracket 218 to lock the reset button 140 by being inserted into the hook passage 198 of the reset guide 190.

The solenoid is magnetized by an electric signal from one of the first and second trip switches 171 and 172 and the reset switch 180 that are operated by the first and second test buttons 131 and 132 and the reset button 140, respectively, or by an unbalanced voltage signal such as an arc.

Figure 8:
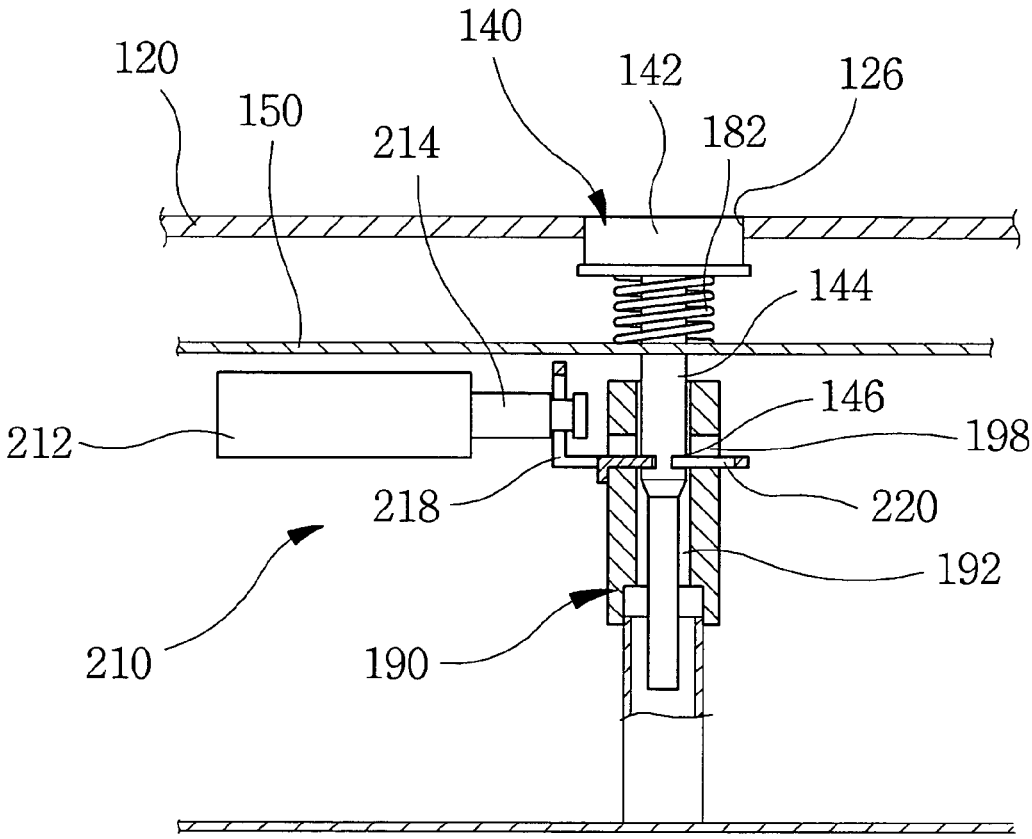
FIG. 8 is an assembled sectional view illustrating a reset button, reset guide, and locking portion of a receptacle according to a first embodiment of the present invention.

FIG. 8 is a partial assembled sectional view illustrating the reset button, the reset guide, and the locking portion.

As shown in the drawing, the press portion 142 of the reset button 140 is externally exposed through a button hole 126 formed on the cover 120, and the extending shaft 144 extending from the press portion 142 is inserted into the insertion hole 192 of the reset guide 190.

The latch 220 of the locking portion 210 is horizontally inserted into the hook passage 198 of the reset guide 190 to selectively lock the extending shaft 144 ascending and descending along the insertion hole 192. At this point, the latch 220 is hooked on the hook groove 146 formed on the outer circumference of the extending shaft 144.

Meanwhile, in order for a user to easily identify current states of the buttons of the receptacle, there are provided a plurality of LED lamps in the present invention.

Figure 9:
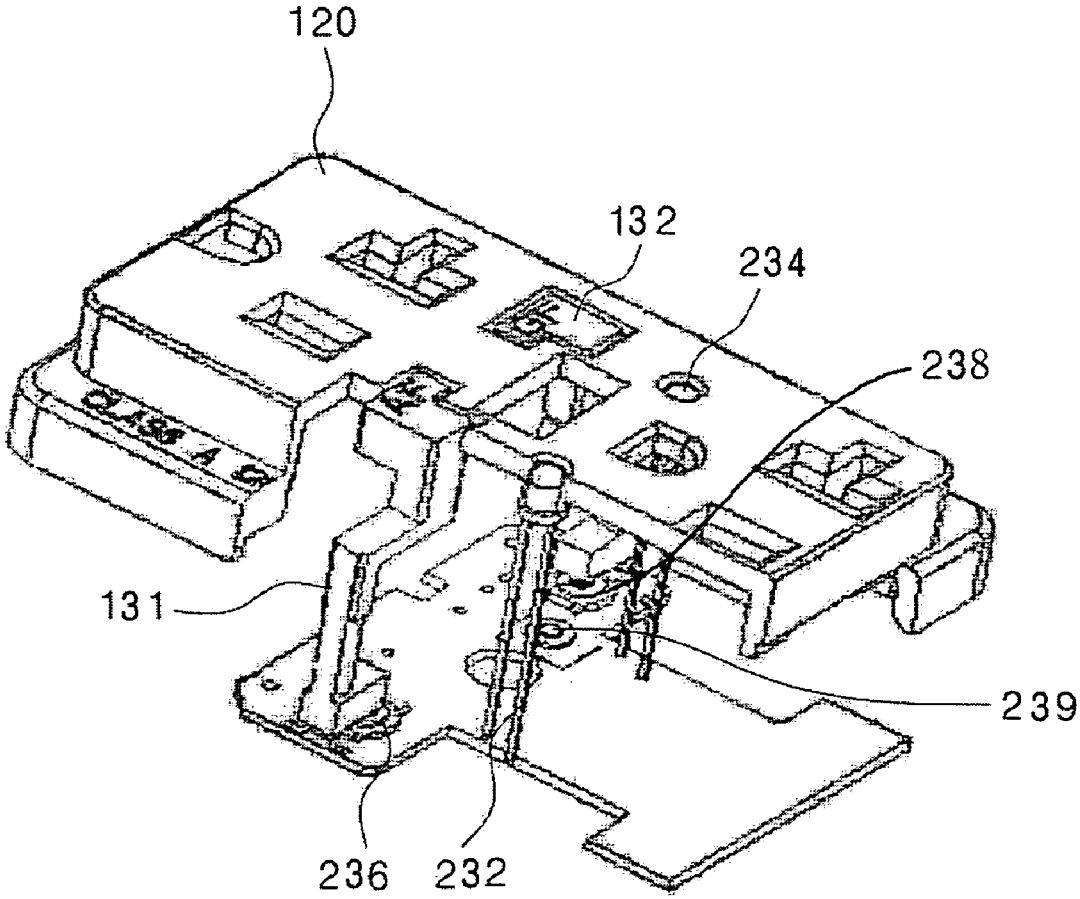
FIG. 9 is a perspective view illustrating a relative location between LED lamps and buttons of a receptacle according to a preferred embodiment of the present invention.

FIG. 9 shows a perspective view illustrating the disposition of the LED lamps.

That is, two fault display lamps 232 and 234 are disposed in the outer case 110 and exposed through the cover 120.

The fault display lamps 232 and 234 emit, for example, a green light when the receptacle 100 is in a normal state and emit, for example, a red light when there is a fault in the receptacle 100, thereby making it possible for the user to easily identify if there is a fault in the receptacle 100 by checking the color of the fault display lamps 232 and 234.

In addition, disposed on an inner bottom of the outer case 110 are first and second test lamps 236 and 238 corresponding to the first and second test buttons 131 and 132.

The first and second test lamps 236 and 238 emit, for example, a green light when the first and second buttons 131 and 132 are not being operated and emit, for example, a red light when the first and second test buttons 131 and 132 are pressed.

Particularly, in order for the user to easily identify the states of the first and second buttons 131 and 132 even at night, it is preferable that the first and second test buttons 131 and 132 are formed of a transparent material such as an acryl plate so that the light emitted from the first and second test lamps 236 and 238 can transmit therethrough.

Disposed on the inner bottom of the outer case 110 is a reset lamp 239 corresponding to the reset button 140.

Since the function of the reset lamp 239 is identical to those of the first and second test lamps 236 and 238, the detailed description thereof will be omitted herein. Likewise, it is preferable the reset button is also made of the transparent material.

The process for performing the test and reset operations of the receptacle according to the first embodiment of the present invention will be described hereinafter more in detail.

In order to initialize the circuit of the receptacle for which a wiring is originally completed by a wiring system, the press portion of the reset button 140 exposed through the button hole 126 of the cover 120 is first pressed.

As a result, the extending shaft 144 extending downward from the press portion 142 is inserted into the insertion hole 192 of the reset guide 190.

The extending shaft 144 inserted into the insertion hole 192 is locked by the latch 220 horizontally inserted in the hook passage 198 of the reset guide 190. That is, when the extending shaft 144 is inserted up to a location where the hook groove 146 formed on the outer circumference of the extending shaft 144 meets the latch 220, the latch 220 is caught on the hook groove 146 by the elastic force of the third spring 216, thereby locking the reset button 140.

The reset button 140 locked by the latch 220 moves downward together with the reset guide 190 by pressing force, thereby operating the reset switch 180 located under the press boss 196 to initialize the receptacle 100.

When the pressing force is released from the reset button 140, the reset button 140 moves upward by the elastic force of the second spring 182 to return to its initial position. At this point, the latch 220 hooked on the hook groove 146 formed on the extending shaft 144 of the reset button 140 moves together with the reset button 140 in a state where it is inserted into the hook passage 198 of the reset guide 190, thereby moving the reset button 140 upward together with the reset guide 190.

By the upward movement, the terminals seated on the base 194 of the reset guide 190 are also moved upward to contact terminals formed on connecting holes 124 of the cover 120, thereby allowing a current to flow in the receptacle 100.

Meanwhile, when any one of the first and second fault display lamps 232 and 234 emitting the green light is changed to emit the red light by a fault in the receptacle 100, the user performs the testing and tripping operations.

The tripping operation may be performed by the user forcedly pressing the first and second buttons 131 and 132 or may be automatically performed by an electric signal transmitted from the first and second fault display lamps 232 and 234.

Here, the former will be described.

When the user presses, for example, the first test button 131, the first test button 131 presses the first trip switch 171 disposed on the inner bottom of the outer case 110, thereby performing the tripping operation.

At this point, the first test lamp 236 emitting the green light is changed to emit the red light. The red light is transmitted through the first test button 131 formed of the transparent material, allowing the user to immediately identify the operation state of the first test button 131.

At this point, the first trip switch 171 transmits an electric signal to the solenoid 212 immediately after the first trip switch 171 is pressed, thereby magnetizing the solenoid 212.

When the solenoid 212 is magnetized, the plunger 214 is moved while compressing the third spring 216. At this point, since the latch 220 is also moved together with the plunger, the locking state of the reset button 140 is released.

By the release of the locking state, the reset button 140 moves upward by the second spring 182 such that the press portion 142 thereof can be exposed through the button hole 124 of the cover 120.

The reset guide 190 is returned downward by elastic force of the terminals seated on the base 194. As a result, the contacting state between the terminals seated on the base 194 and the terminals formed on the connecting holes 124 is released, thereby cutting off the current flowing in the receptacle 100.

When pressing force applied to the first test button 131 is released after the test operation is completed, the first test button 131 is returned to its initial position by the spring 160.

Afterwards, in order to reuse the receptacle 100 after the test operation, the reset button 140 is pressed for the reset operation. Since the process of the reset operation is identical to that of the initializing operation described above, the detailed description thereof will be omitted herein.

By the reset operation, the reset lamp 239 emitting the red light is changed to emit the green light. Since the green light is transmitted through the reset button 140 formed of the transparent material, the user can immediately identify the operation state of the reset button 140.

Although the reset lamp 239 is designed to emit light by the user pressing the reset button 140, the present invention is not limited to this. That is, the reset lamp 239 may be designed to automatically emit light by an external electric signal from, for example, the first and second test lamps 236 and 238.

Second Embodiment

Figure 10:
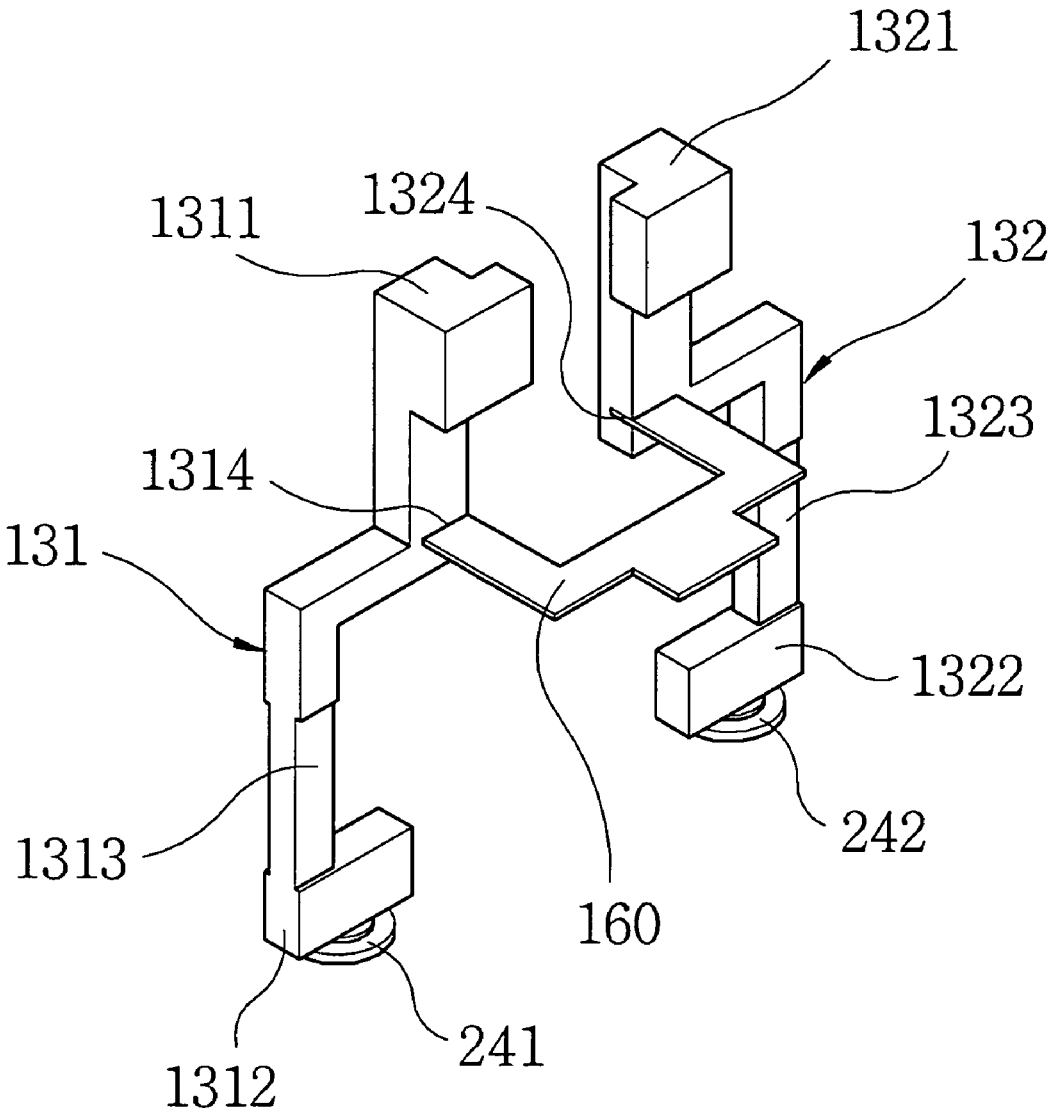
FIG. 10 is an enlarged perspective view illustrating first and second test buttons of a receptacle according to a second embodiment of the present invention.

FIG. 10 shows an enlarged perspective view illustrating first and second test buttons of a receptacle according to a second embodiment of the present invention.

In this embodiment, first and second tap buttons 241 and 242 are respectively attached on the contacting portions 1312 and 1322 of the respective first and second test buttons 131 and 132.

As shown in the drawing, when pressing force is applied to one of the first and second test buttons 241 and 242, the corresponding tab button 241 (242) operates the corresponding trip switch 171 (172), thereby performing the test operation through the processes identical to those described in the first embodiment.

In this embodiment, since the first and second test buttons 131 and 132 for the ground and arc fault tests are designed to operate the first and second tab buttons 241 and 242 without generating a short circuit on an integrated circuit, the test can be more safely realized.

Third Embodiment

Figure 11:
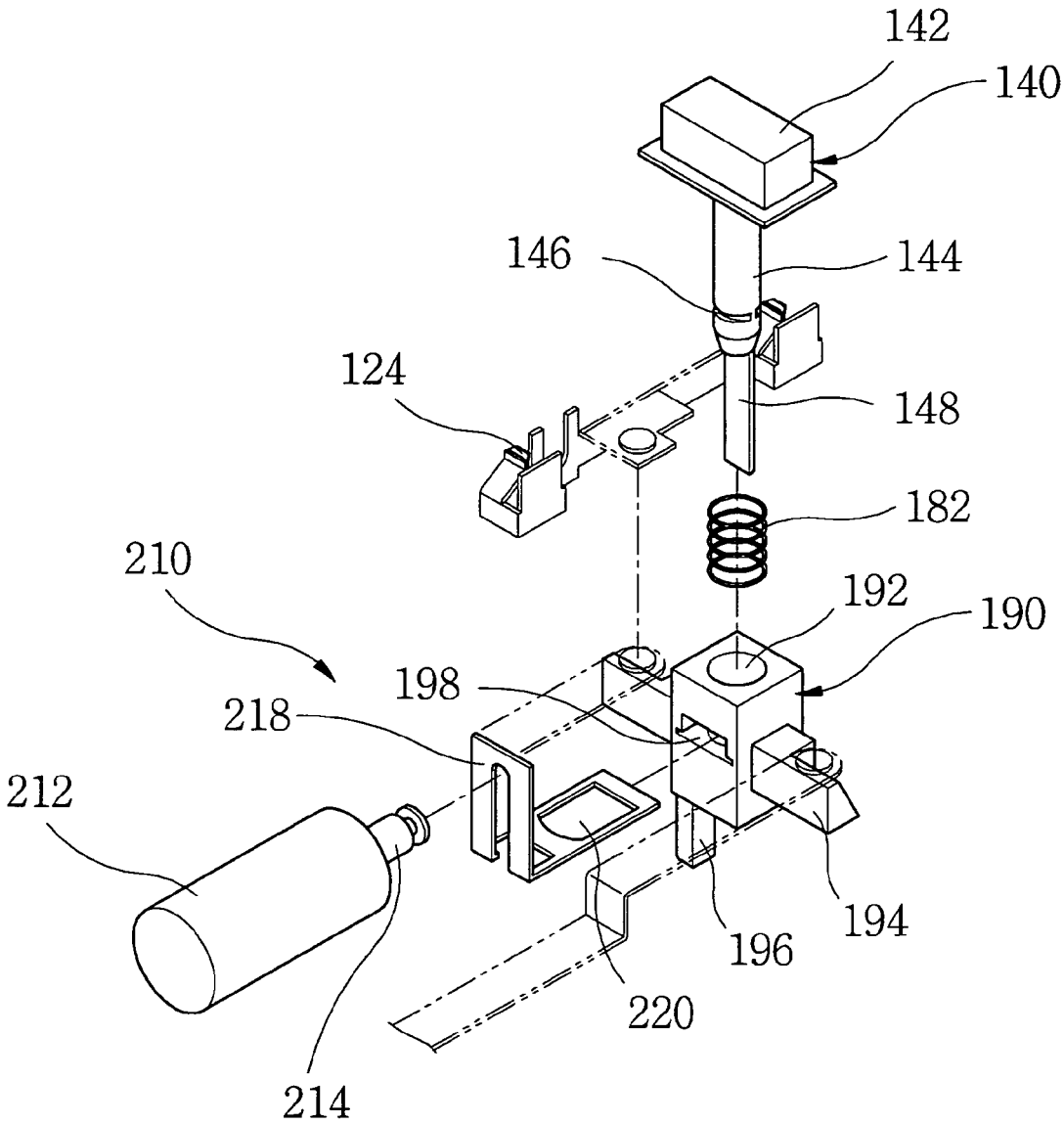
FIG. 11 is an exploded perspective view illustrating a reset button, reset guide, and locking portion of a receptacle according to a third embodiment of the present invention.

FIG. 11 shows an exploded perspective view illustrating a reset button, reset guide, and locking portion of a receptacle according to a third embodiment of the present invention.

A reset button 140 of this embodiment includes a press portion 142 externally exposed through the cover 120 (see FIG. 2) and an extending shaft 144 extending downward from the press portion 142.

The extending shaft 144 is provided at an outer circumference with a hook groove 146. The extending shaft 144 is further provided at a portion below the hook groove 146 with an intermitting groove 148 having a semi-cylindrical shape.

The reset button 140 is disposed to be movable in a vertical direction of the outer case 110 (see FIG. 2) and is biased upward by a second spring 182.

A reset guide 190 is provided with an insertion hole 192 through which the extending shaft 144 of the reset button 140 is inserted, a hook passage 198 formed in a perpendicular direction with respect to the insertion hole 192, a base 194 on which terminals are seated, and a press boss 196 for pressing the reset switch.

A locking portion 210 includes a solenoid 212 magnetized by an electric signal, a plunger 214 moving in a direction by the magnetization of the solenoid 212, a third spring 216 for returning the moved plunger 214 to an initial portion when the magnetization of the solenoid 212 is released, a bracket 218 coupled on a front end of the plunger 214, and a latch 220 extending from the bracket 218 to lock the reset button 140 by being inserted into the hook passage 198 of the reset guide 190.

The solenoid 212 is magnetized by an electric signal from one of the first and second trip switches 171 and 172 and the reset switch 180 that are operated by the first and second test buttons 131 and 132 and the reset button 140, respectively, or by an unbalanced voltage signal such as an arc.

Meanwhile, in order to effectively use the limited space of the receptacle and reduce the size of the receptacle, the first and second test buttons 131 and 132 may be integrated into a single button so that the arc and ground faults can be tested by operating the single button.

Figure 12:
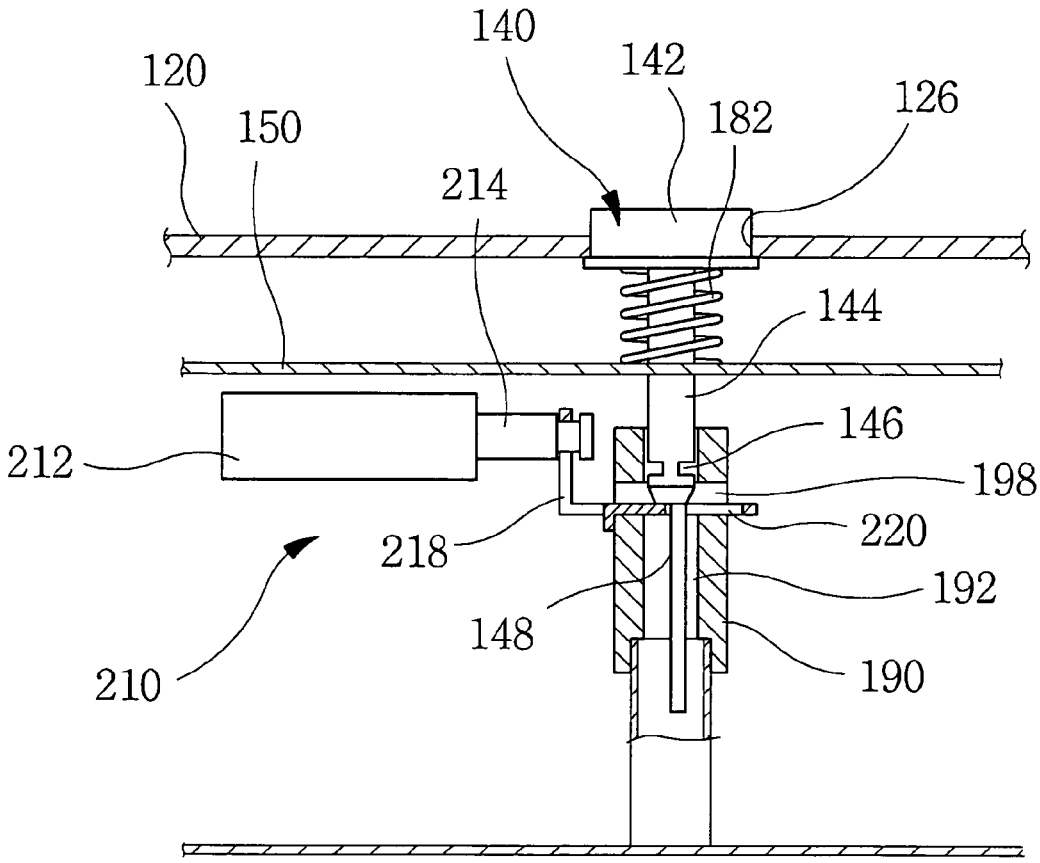
FIG. 12 is an assembled sectional view illustrating a reset button, reset guide, and locking portion of a receptacle according to a third embodiment of the present invention.

FIG. 12 shows a partial assembled sectional view illustrating the reset button, the reset guide, and the locking portion.

As shown in the drawing, the press portion 142 of the reset button 140 is externally exposed through a button hole 126 formed on the cover 120, and the extending shaft 144 extending from the press portion 142 is inserted into the insertion hole 192 of the reset guide 190.

The latch 220 of the locking portion 210 is horizontally inserted into the hook passage 198 of the reset guide 190 to interrupt the intermitting groove 148 ascending and descending in the insertion hole 192.

When the reset button 140 is pressed to initialize the circuit of the receptacle 100 for which a wiring is originally completed by a wiring system, if there is a wire connection fault, an electric signal is not generated even when the reset switch 180 is operated by the press boss 194 of the reset guide 190.

Therefore, the solenoid 212 of the locking portion 210 is not magnetized, and thereby the latch 220 designed to cooperate with the solenoid 212 is not also operated. As a result, the interruption state of the intermitting groove 148 is maintained, thereby disallowing the initialization of the receptacle 100 and the current flow.

Meanwhile, when there is no wire connection fault in the receptacle 100, the initializing operation is realized through the processes identical to those of the first embodiment.

As described above, since the inventive receptacle has the first and second test buttons, it is possible to detect and test the arc fault caused by a wire damage a mechanical and electrical stress by an excessive current and an excessive use, a wire connection defect, a mechanical damage of an insulation and wiring structure, and the like.

In addition, since the first and second test buttons for the ground and arc fault tests are designed to operate the first and second tab buttons without generating a short circuit on an integrated circuit, the test can be more safely realized.

Furthermore, since each of the first and second test buttons is formed in a single body extending from a top to a bottom of the receptacle, it is possible to reduce the size of the receptacle, making it possible to easily install the receptacle in use.

Particularly, the reset operation of the receptacle can be easily realized by the reset button and the locking portion.

Furthermore, since it is easy to identify if there is any fault such as a wire connection fault by pressing the reset button when the wiring is originally completed in the receptacle, it is possible to prevent an accident such as the malfunction of an electric device (a heating device, an office machine and the like) and the fire, which may be caused by either an arc generated on the input terminal or an abnormal current such as an excessive load generated on the output terminal.

In addition, since it is easy for even a novice worker to inspect a fault such as the wire connection fault during a wire connection work, the working efficiency can be improved.

It will be apparent to those skilled in the art that various modifications and variations can be made in the present invention. Thus, it is intended that the present invention covers the modifications and variations of this invention provided they come within the scope of the appended claims and their equivalents.

For example, in order to reduce the manufacturing costs by reducing the size of the receptacle, the first and second test buttons may be integrated into a single button.

What is claimed is:

1. A receptacle comprising:

an insulated outer case;

first and second trip switches formed on an inner bottom of the insulated outer case;

a reset switch formed on the inner bottom of the insulated outer case;

a cover disposed on a top of the insulated outer case;

first and second test buttons disposed in the insulated outer case to be movable in a vertical direction, each of the first and second test buttons having a bottom adjacent to the corresponding trip switch and a top exposed through the cover;

a first spring for biasing the first and second test buttons to an initial position;

a reset button disposed in the insulated outer case to be movable in the vertical direction, the reset button having a bottom adjacent to the reset switch and a top exposed through the cover; and a locking portion for selectively locking the reset button in response to the vertical motion of the first and second test button.

2. The receptacle of claim 1 wherein the insulated outer case is provided with first and second button receiving portions for respectively receiving the first and second test buttons.

3. The receptacle of claim 1 wherein the cover is provided with first and second button holes through which the first and second test buttons are respectively exposed.

4. The receptacle of claim 2 wherein the first button functions to test an arc fault.

5. The receptacle of claim 1 wherein the second button functions to test a ground fault.

6. The receptacle of claim 1 wherein each of the first and second buttons comprises:

a press portion supported on the cover to be movable in the vertical direction;

a contacting portion for pressing the corresponding trip switch to operate the corresponding trip switch; and a connecting portion for connecting the press portion to the contacting portion.

7. The receptacle of claim 6 wherein each of the first and second buttons further comprises a tap button attached on the contacting portion to press the corresponding trip switch.

8. The receptacle of claim 6 wherein the first and second test buttons are symmetrical to each other.

9. The receptacle of claim 1 wherein the first spring is formed of a leaf spring.

10. The receptacle of claim 1 wherein the first and second test buttons are provided with a spring groove in which the first spring is inserted.

11. The receptacle of claim 1 further comprising:

a reset guide for guiding the vertical motion of the reset button; and a press boss for pressing the reset switch in accordance with a vertical motion of the reset guide cooperating with the reset button.

12. The receptacle of claim 11 further comprising a second spring for biasing the reset button toward the cover.

13. The receptacle of claim 1 wherein the locking portion comprises:

a solenoid magnetized by an electric signal from one of the trip and reset switches that are operated by the test and reset buttons, respectively;

a plunger designed to move forward and rearward according to a magnetizing state of the solenoid;

a third spring for biasing the plunger to an initial position; and a latch installed on a front end of the plunger to selectively lock the reset button in accordance with a moving direction of the plunger.

14. The receptacle of claim 13 wherein the reset button is provided at an outer circumference with a hook groove on which the latch is designed to be hooked.

15. The receptacle of claim 1 further comprising a fault display lamp disposed in the insulated outer case and exposed through the cover.

16. The receptacle of claim 1 further comprising first and second test lamps disposed on the inner bottom of the insulated outer case to respectively correspond to the bottoms of the first and second test buttons, wherein the first and second test buttons are formed of a transparent material so that light emitted from the test lamp can transmit through the first and second test buttons.

17. The receptacle of claim 1 further comprising a reset lamp disposed on the inner bottom of the insulated outer case to correspond to the bottom of the reset button, wherein the reset button is formed of a transparent material so that light emitted from the reset lamp can transmit though the reset button.

18. A receptacle comprising:

an insulated outer case;

trip and reset switches formed on an inner bottom of the insulated outer case;

a cover disposed on a top of the outer case;

a test button disposed in the insulated outer case to be movable in a vertical direction, the test button having a bottom adjacent to the trip switch and a top exposed through the cover; and a reset button disposed in the insulated outer case to be movable in a vertical direction, the reset button having a press portion exposed through the cover and an extending shaft extending from the press portion, the extending shaft being provided at an outer circumference with a hook groove, wherein the receptacle further comprises:

a reset guide for guiding the reset button, the reset guide being provided at an end with a press boss for pressing the reset switch while moving in a vertical direction; and a locking portion having a latch for selectively latching the extending shaft of the reset button guided by the reset guide to intermit a reset operation of the reset button.

19. The receptacle of claim 18 wherein the locking portion comprises:

a solenoid magnetized by an operation of one of the trip and reset switches;

a plunger designed to move in a direction by the magnetization of the solenoid, the plunger being coupled on an end of the latch; and a third spring for biasing the plunger to an initial position.

20. The receptacle of claim 18 wherein the extending shaft of the reset button is further provided with an intermitting groove below the hook groove, the intermitting groove being designed to be intermitted by the latch of the locking portion when there is a wire connection fault in the receptacle.

21. The receptacle of claim 20 wherein the locking portion is formed in a semi-cylindrical shape formed by cutting a portion of the extending shaft.

22. The receptacle of claim 18 wherein the reset guide is provided with an insertion hole through which the extending shaft of the reset button is inserted, a hook passage formed in a perpendicular direction with respect to the insertion hole, a base on which terminals are seated, and a press boss for pressing the reset switch.

* * * * *